US011478841B2

(12) United States Patent
Lee et al.

(10) Patent No.: US 11,478,841 B2
(45) Date of Patent: Oct. 25, 2022

(54) METHOD OF REPEATEDLY PROCESSING METAL

(71) Applicants: AGENCY FOR DEFENSE DEVELOPMENT, Daejeon (KR); GANGNEUNG-WONJU NATIONAL UNIVERSITY INDUSTRY ACADEMY COOPERATION GROUP, Gangneung-si (KR)

(72) Inventors: Seong Lee, Daejeon (KR); Hyo Tae Jeong, Gangneung-si (KR); Sang Chul Kwon, Gangneung-si (KR); Sun Tae Kim, Gangneung-si (KR); Da Vin Kim, Gangneung-si (KR); Shi Hoon Choi, Gangneung-si (KR)

(73) Assignees: AGENCY FOR DEFENSE DEVELOPMENT, Daejeon (KR); GANGNEUNG-WONJU NATIONAL UNIVERSITY INDUSTRY ACADEMY COOPERATION GROUP, Gangneung-si (KR)

( * ) Notice: Subject to any disclaimer, the term of this patent is extended or adjusted under 35 U.S.C. 154(b) by 0 days.

(21) Appl. No.: 17/029,641

(22) Filed: Sep. 23, 2020

(65) Prior Publication Data

US 2022/0048094 A1 Feb. 17, 2022

(30) Foreign Application Priority Data

Aug. 13, 2020 (KR) ..... 10-2020-0101907
Aug. 13, 2020 (KR) ..... 10-2020-0101909

(51) Int. Cl.
*B21J 5/02* (2006.01)

(52) U.S. Cl.
CPC ..... *B21J 5/025* (2013.01)

(58) Field of Classification Search
CPC ..... B21J 5/025; B21J 5/02; B21J 5/00; B21J 5/08; B21J 13/00; B21J 13/02; B21J 9/022; B21J 9/00
(Continued)

(56) References Cited

U.S. PATENT DOCUMENTS 9,586,256 B2 * 3/2017 Miura ..... C22C 9/00
2017/0342537 A1 * 11/2017 Lee ..... B21J 5/08

FOREIGN PATENT DOCUMENTS

JP 4797170 B2 10/2007
KR 101630667 B1 * 6/2016 ..... B21J 1/02
(Continued)

*Primary Examiner* — Shelley M Self
*Assistant Examiner* — Teresa A Guthrie

(57) ABSTRACT

A method of processing hexahedral metal includes an X-axis edge forging step to press two X-axis edges on opposite sides to each other from a center of the hexahedral metal among edges formed in an X-axis direction, process the hexahedral metal into hexagonal prismatic metal, and restore the hexagonal prismatic metal to hexahedral metal, a Y-axis edge forging step to press two Y-axis edges on opposite sides to each other from the center of the hexahedral metal among edges formed in a Y-axis direction, process the hexahedral metal into hexagonal prismatic metal, and restore the hexagonal prismatic metal to hexahedral metal, and a Z-axis edge forging step to press two Z-axis edges on opposite sides to each other from the center of the hexahedral metal among edges formed in a Z-axis direction, process the hexahedral metal into hexagonal prismatic metal, and restore the hexagonal prismatic metal to hexahedral metal.

7 Claims, 12 Drawing Sheets

(58) Field of Classification Search
USPC ..... 72/52
See application file for complete search history.

(56) References Cited

FOREIGN PATENT DOCUMENTS

| | | | |
|---|---|---|---|
| KR | 101632024 | B1 | 6/2016 |
| KR | 102072197 | B1 | 3/2020 |

* cited by examiner

METHOD OF REPEATEDLY PROCESSING METAL

CROSS-REFERENCE TO RELATED APPLICATION(S)

This application claims the priority benefit of Korean Patent Application No. 10-2020-0101907 filed on Aug. 13, 2020, and Korean Patent Application No. 10-2020-0101909 filed on Aug. 13, 2020, in the Korean Intellectual Property Office, the disclosures of each of which are incorporated herein by reference for all purposes.

BACKGROUND

1. Field

One or more example embodiments relate to a method of repeatedly processing metal, and more particularly, to a metal processing method that repeatedly forges metal of an overall hexahedral form to process the metal to be of a compact structure.

2. Description of Related Art

In general, the characteristics of metal may vary depending on the state of a microstructure or texture of the inside of the metal. For example, as the structure is finer or the texture grows further, the mechanical or physical properties of a metal material, for example, the strength or hardness, durability, and the like, may be enhanced.

Thus, controlling the internal structure by applying plastic deformation or heat treatment to a metal material may be one of the major metal processing methods.

However, some metal processing methods, such as, for example, rolling, extruding, drawing, and the like may cause a great plastic deformation and a change in an outer form of metal, and thus there may be a limit to the form or shape that can be implemented by an additional process. Thus, to reduce or minimize such a limit in deformation, an equal channel angular pressing (ECAP) process that applies the plastic deformation without changing a size of a sample may be used to repeatedly add a strong plastic deformation without changing a size of metal.

However, due to a frictional contact from the characteristics of such a process, a considerably high degree of stress may be required. In addition, a deformation may not be uniform in a start portion and an end portion of a metal material, and thus such a non-uniform portion of the start portion and the end portion may need to be removed. Thus, there may be a great loss of the material as the process proceeds.

SUMMARY

An aspect provides a metal processing method to process metal to be of a homogeneous ultra-fine microstructure.

In detail, the metal processing method may be provided to solve such issues as described above. The metal processing method may repeatedly process edges of three-axial directions of hexahedral metal through diagonal forging (DF) and return-DF (R-DF) to minimize a change in an outer form of the metal and add a uniform deformation to the inside of the metal, thereby uniformly controlling a microstructure and a texture. The tasks or issues to be solved according to example embodiments of the present disclosure are not limited to what has been described above.

According to an example embodiment, there is provided a method of processing hexahedral metal. The method includes an X-axis edge forging step to press two X-axis edges on opposite sides to each other from a center of the hexahedral metal among edges formed in an X-axis direction, process the hexahedral metal into hexagonal prismatic metal, and restore the hexagonal prismatic metal to hexahedral metal, a Y-axis edge forging step to press two Y-axis edges on opposite sides to each other from the center of the hexahedral metal among edges formed in a Y-axis direction, process the hexahedral metal into hexagonal prismatic metal, and restore the hexagonal prismatic metal to hexahedral metal, and a Z-axis edge forging step to press two Z-axis edges on opposite sides to each other from the center of the hexahedral metal among edges formed in a Z-axis direction, process the hexahedral metal into hexagonal prismatic metal, and restore the hexagonal prismatic metal to hexahedral metal. Each of the X-axis edge forging step, the Y-axis edge forging step, and the Z-axis forging step may be performed twice.

The Y-axis edge forging step may be performed after the X-axis edge forging step, and the Z-axis edge forging step may be performed after the Y-axis edge forging step.

The X-axis edge forging step may include a first X-axis edge forging step and a second X-axis edge forging step to be performed after the first X-axis edge forging step. Each of the first X-axis edge forging step and the second X-axis edge forging step may include an X-axial DF step to press two X-axis edges on opposite sides to each other from the center of the hexahedral metal among the edges formed in the X-axis direction and process the hexahedral metal into the hexagonal prismatic metal, and an X-axial R-DF step to be performed after the X-axial DF step to restore the hexagonal prismatic metal to the hexahedral metal.

Each of the two X-axis edges that are pressed in the X-axial DF step may be configured to be flattened in the X-axial R-DF step, and may be formed to be at a center of one of six faces forming the hexahedral metal.

Each of the two X-axis edges that are pressed in the X-axial DF step in the first X-axis edge forging step may be configured to form one of 12 edges forming the hexahedral metal after the X-axial R-DF step in the second X-axis edge forging step.

The X-axial DF step may be performed on a first mold that accommodates therein one of the edges formed in the X-axis direction and restricts a deformation of a face vertical to the edge formed in the X-axis direction. The X-axial R-DF step may be performed on a second mold that supports one side face of the hexagonal prismatic metal and restricts the deformation of the face vertical to the edge formed in the X-axis direction.

The Y-axis edge forging step may include a first Y-axis edge forging step and a second Y-axis edge forging step to be performed after the first Y-axis edge forging step. Each of the first Y-axis edge forging step and the second Y-axis edge forging step may include a Y-axial DF step to press two Y-axis edges on opposite sides to each other from the center of the hexahedral metal among the edges formed in the Y-axis direction and process the hexahedral metal into the hexagonal prismatic metal, and a Y-axial R-DF step to be performed after the Y-axial DF step to restore the hexagonal prismatic metal to the hexahedral metal.

The Z-axis edge forging step may include a first Z-axis edge forging step and a second Z-axis edge forging step to be performed after the first Z-axis edge forging step. Each of the first Z-axis edge forging step and the second Z-axis edge forging step may include a Z-axial DF step to press two Z-axis edges on opposite sides to each other from the center of the hexahedral metal among the edges formed in the Z-axis direction and process the hexahedral metal into the hexagonal prismatic metal, and a Z-axial R-DF step to be performed after the Z-axial DF step to restore the hexagonal prismatic metal to the hexahedral metal.

Additional aspects of example embodiments will be set forth in part in the description which follows and, in part, will be apparent from the description, or may be learned by practice of the disclosure.

BRIEF DESCRIPTION OF THE DRAWINGS

These and/or other aspects, features, and advantages of the present disclosure will become apparent and more readily appreciated from the following description of example embodiments, taken in conjunction with the accompanying drawings of which.

DETAILED DESCRIPTION

Figure 1:
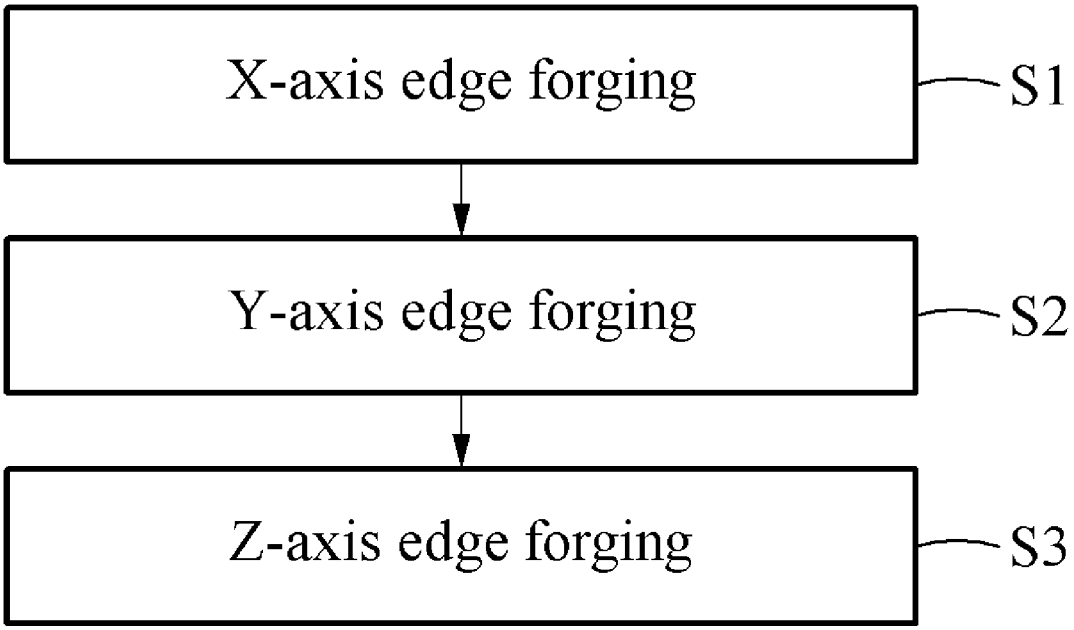
FIG. 1 is a flowchart illustrating an example of a method of processing hexahedral metal according to an example embodiment.

Hereinafter, example embodiments will be described in detail with reference to the accompanying drawings. It should be understood, however, that there is no intent to limit this disclosure to the particular example embodiments disclosed. On the contrary, example embodiments are to cover all modifications, equivalents, and alternatives falling within the scope of the example embodiments.

The terminology used herein is for the purpose of describing particular example embodiments only and is not intended to be limiting. As used herein, the singular forms "a," "an," and "the," are intended to include the plural forms as well, unless the context clearly indicates otherwise. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

Unless otherwise defined, all terms, including technical and scientific terms, used herein have the same meaning as commonly understood by one of ordinary skill in the art to which this disclosure pertains based on an understanding of the present disclosure. Terms, such as those defined in commonly used dictionaries, are to be interpreted as having a meaning that is consistent with their meaning in the context of the relevant art and the present disclosure, and are not to be interpreted in an idealized or overly formal sense unless expressly so defined herein.

In the description of example embodiments, detailed description of well-known related structures or functions will be omitted when it is deemed that such description will cause ambiguous interpretation of the present disclosure.

Terms such as first, second, A, B, (a), (b), and the like may be used herein to describe components. Each of these terminologies is not used to define an essence, order, or sequence of a corresponding component but used merely to distinguish the corresponding component from other component(s). It should be noted that if it is described in the specification that one component is "connected," "coupled," or "joined" to another component, a third component may be "connected," "coupled," and "joined" between the first and second components, although the first component may be directly connected, coupled or joined to the second component. In addition, it should be noted that if it is described in the specification that one component is "directly connected" or "directly joined" to another component, a third component may not be present therebetween. Likewise, expressions, for example, "between" and "immediately between" and "adjacent to" and "immediately adjacent to" may also be construed as described in the foregoing.

Hereinafter, example embodiments will be described in detail with reference to the accompanying drawings. Regarding the reference numerals assigned to the elements in the drawings, it should be noted that the same elements will be designated by the same reference numerals, wherever possible, even though they are shown in different drawings.

FIG. 1 is a flowchart illustrating an example of a method of processing hexahedral metal according to an example embodiment.

Referring to FIG. 1, a metal processing method according to an example embodiment includes an X-axis edge forging step S1, a Y-axis edge forging step S2, and a Z-axis edge forging step S3. Each of the X-axis edge forging step S1, the Y-axis edge forging step S2, and the Z-axis edge forging step S3 may be performed twice. The X-axis edge forging step S1, the Y-axis edge forging step S2, and the Z-axis edge forging step S3 may be performed in sequential order. That is, the Y-axis edge forging step S2 may be performed twice after the X-axis edge forging step S1 is performed twice, and then the Z-axis edge forging step S3 may be performed twice after the Y-axis edge forging step S2 is performed twice.

Figure 3:
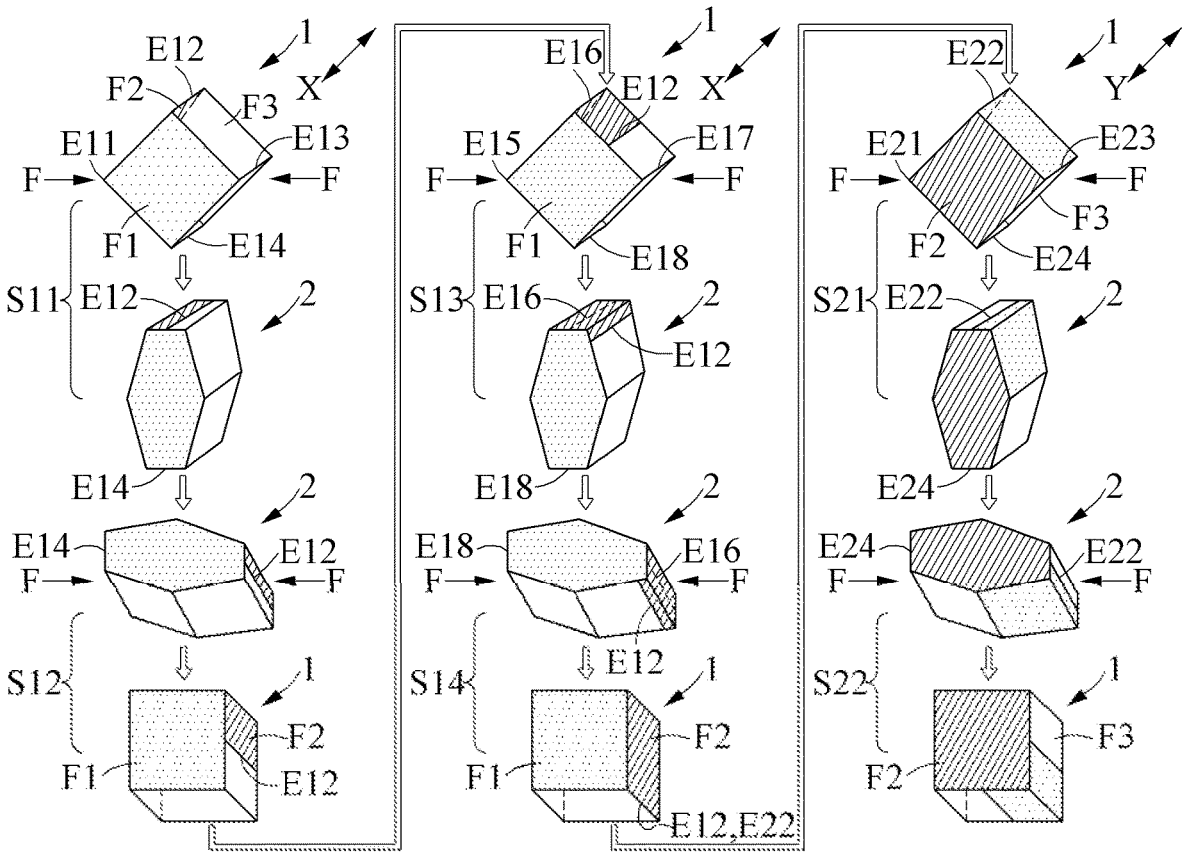
FIG. 3 is a conceptual diagram illustrating in stages a portion of a metal processing step in the metal processing method of FIG. 1.
Figure 4:
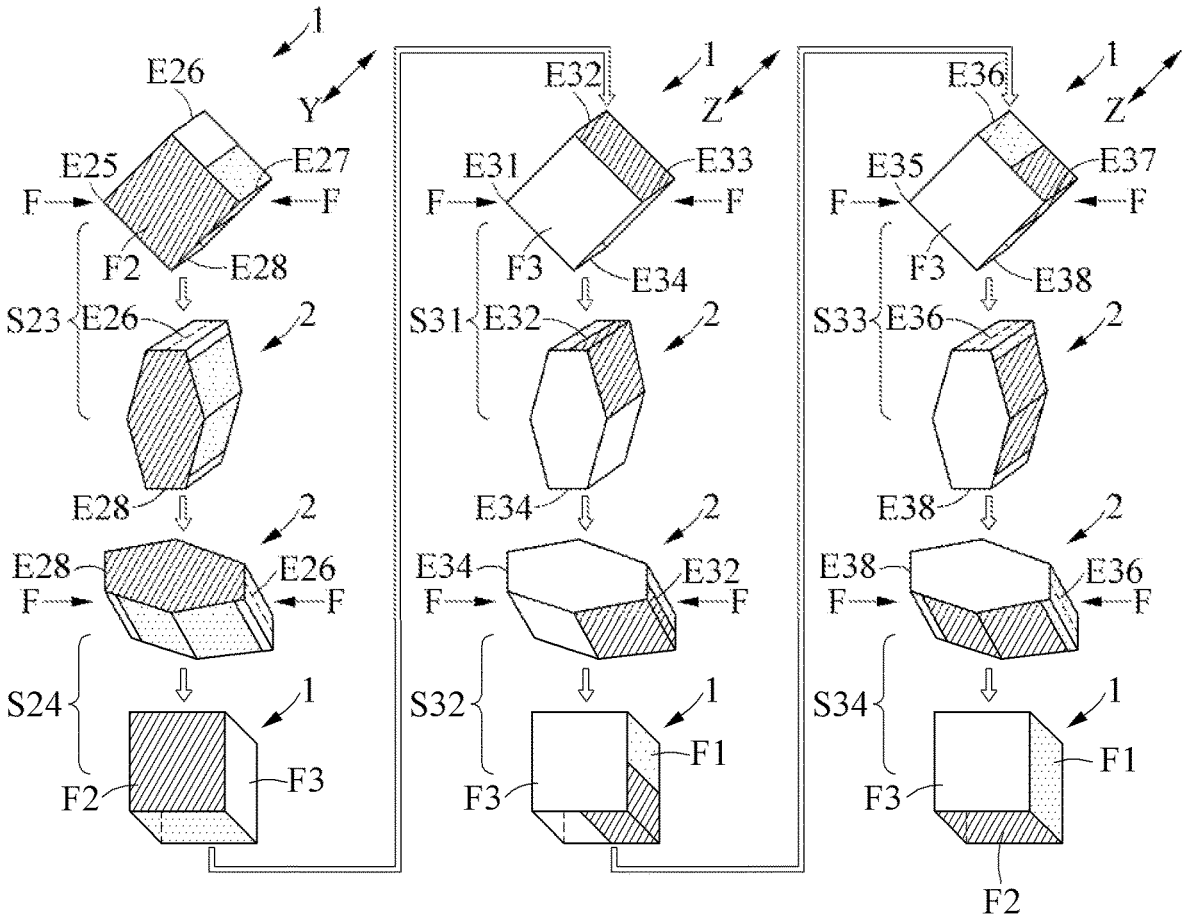
FIG. 4 is a conceptual diagram illustrating in stages a remaining portion of the metal processing step after the portion illustrated in FIG. 3 in the metal processing method of FIG. 1.

A target to be processed may be hexahedral metal 1 in an overall form of a hexahedron that has four edges E11, E12, E13, and E14 in an X-axis direction, and four edges E21, E22, E23, and E24 in a Y-axis direction, and four edges E31, E32, E33, and E34 in a Z-axis direction, as illustrated in FIGS. 3 and 4. However, the hexahedral metal 1 is not be limited to the illustrated form or shape and may be formed in various forms or shapes, or sizes having various ratios. The hexahedral metal 1 may be of a material, for example, tantalum or copper.

For example, the X-axis edge forging step S1 may be to press the four edges E11, E12, E13, and E14 formed in the X-axis direction of the hexahedral metal 1. The Y-axis edge forging step S2 may be to press the four edges E21, E22, E23, and E24 formed in the Y-axis direction of the hexahedral metal 1. The Z-axis edge forging step S3 may be to press the four edges E31, E32, E33, and E34 formed in the Z-axis direction of the hexahedral metal 1.

Figure 2:
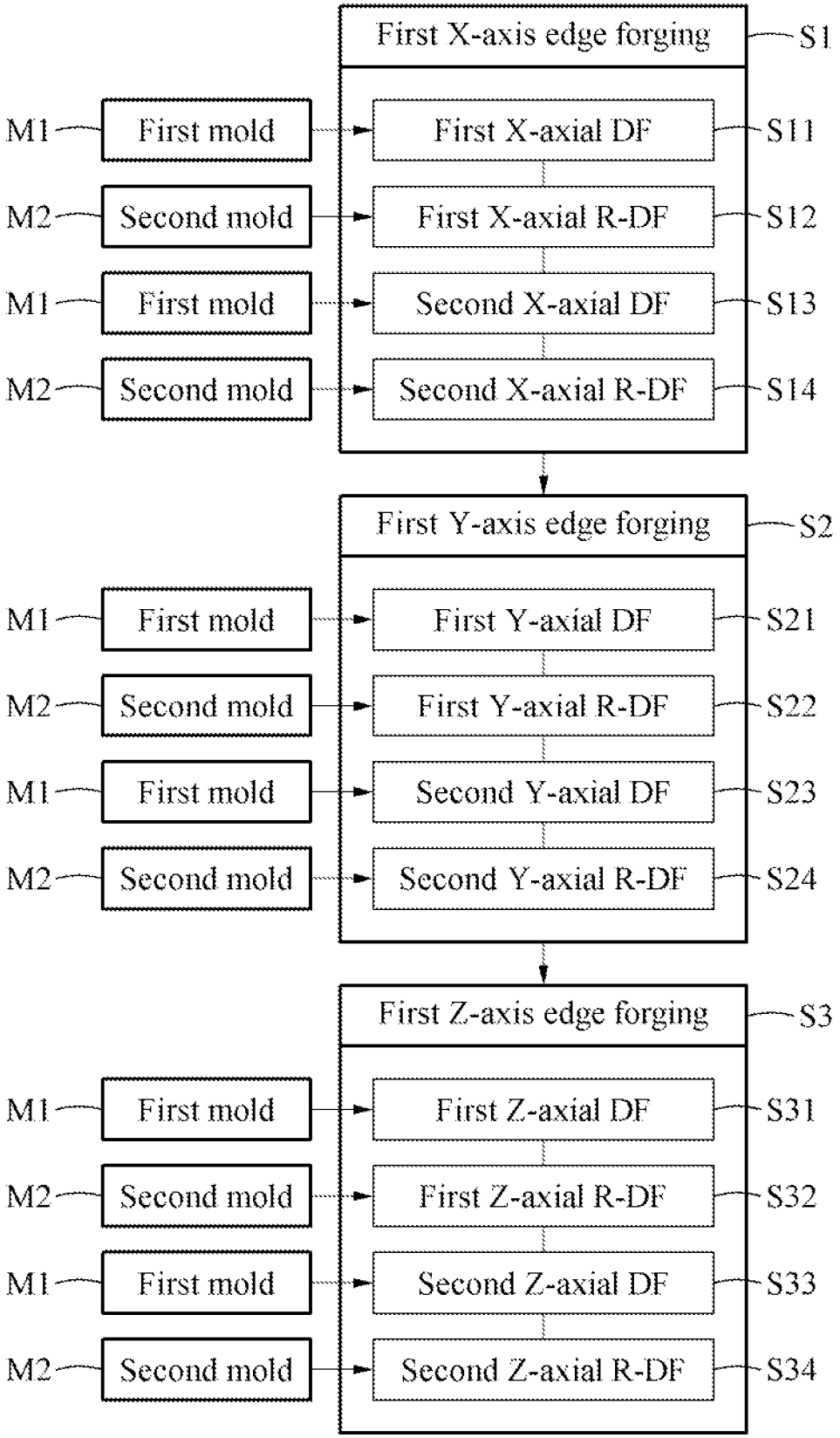
FIG. 2 is a detailed flowchart illustrating the method of processing hexahedral metal of FIG. 1.

FIG. 2 is a detailed flowchart illustrating the method of processing hexahedral metal of FIG. 1.

Referring to FIG. 2, the X-axis edge forging step S1 includes two-time steps. The X-axis edge forging step S1 includes a first X-axis edge forging step and a second X-axis edge forging step to be performed after the first X-axis edge forging step. The first X-axis edge forging step includes a first X-axial diagonal forging (DF) step S11 and a first X-axial return-DF (R-DF) step S12. The second X-axis edge forging step includes a second X-axial DF step S13 and a second X-axial R-DF step S14.

Figure 5:
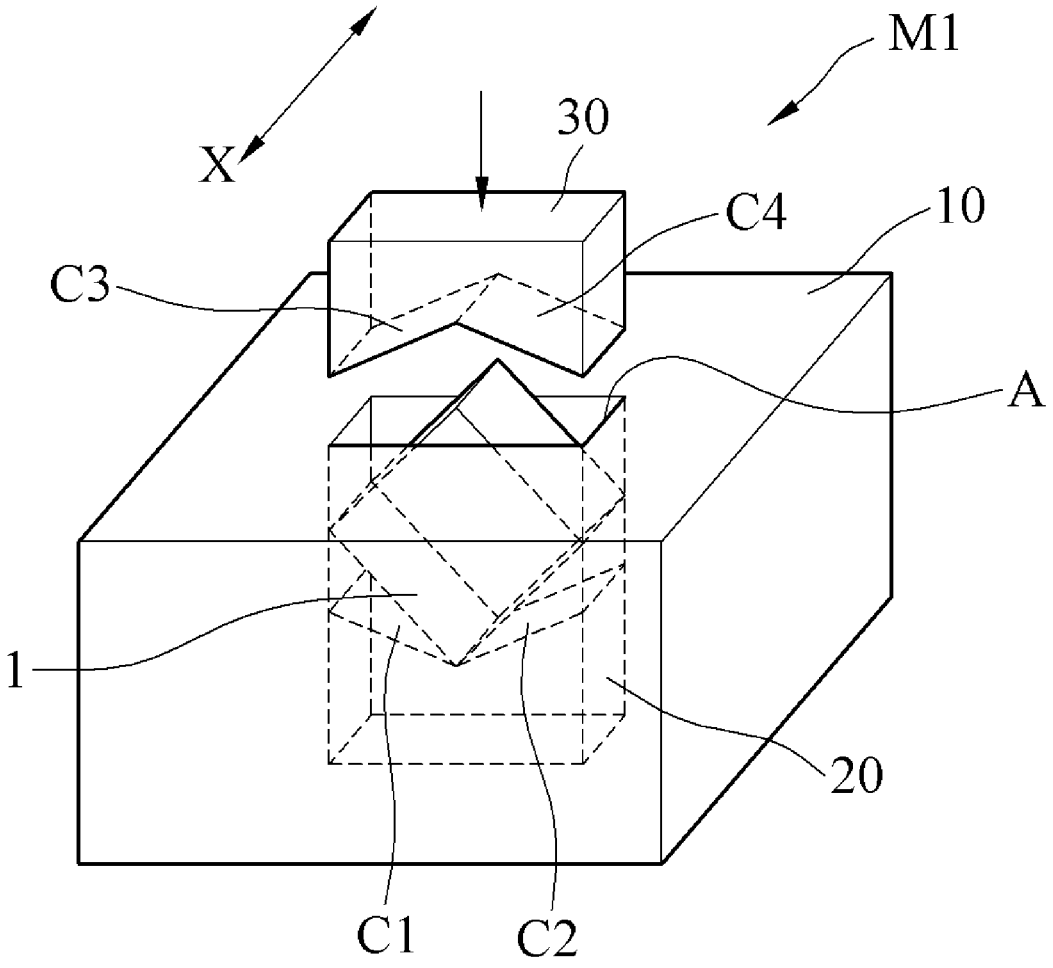
FIG. 5 is a perspective view illustrating a previous state before X-axial diagonal forging (DF) of a first mold that is applied to a metal processing method according to an example embodiment.

The first X-axial DF step S11 and the second X-axial DF step S13 may be performed through a first mold M1 (refer to FIG. 5). The first X-axial R-DF step S12 and the second X-axial R-DF step S14 may be performed using a second mold M2 (refer to FIG. 7).

The Y-axis edge forging step S2 includes two-time steps. The Y-axis edge forging step S2 includes a first Y-axis forging step and a second Y-axis edge forging step to be performed after the first Y-axis edge forging step. The first Y-axis edge forging step includes a first Y-axial DF step S21 and a first Y-axial R-DF step S22. The second Y-axis edge forging step includes a second Y-axial DF step S23 and a second Y-axial R-DF step S24.

The first Y-axial DF step S21 and the second Y-axial DF step S23 may be performed through a first mold M1 (refer to FIG. 5). The first Y-axial R-DF step S22 and the second Y-axial R-DF step S24 may be performed using a second mold M2 (refer to FIG. 7).

The Z-axis edge forging step S3 includes two-time steps. The Z-axis edge forging step S3 includes a first Z-axis forging step and a second Z-axis edge forging step to be performed after the first Z-axis edge forging step. The first Z-axis edge forging step includes a first Z-axial DF step S31 and a first Z-axial R-DF step S32. The second Z-axis edge forging step includes a second Z-axial DF step S33 and a second Z-axial R-DF step S34.

The first Z-axial DF step S31 and the second Z-axial DF step S33 may be performed through a first mold M1 (refer to FIG. 5). The first Z-axial R-DF step S32 and the second Z-axial R-DF step S34 may be performed using a second mold M2 (refer to FIG. 7).

FIG. 3 is a conceptual diagram illustrating in stages a portion of a metal processing step in the metal processing method of FIG. 1. FIG. 4 is a conceptual diagram illustrating in stages a remaining portion of the metal processing step after the portion illustrated in FIG. 3 in the metal processing method of FIG. 1.

Referring to FIGS. 3 and 4, the first X-axial DF step S11 may be to press two edges E11 and E13 disposed in a diagonal direction among edges E11, E12, E13, and E14 in an X-axis direction of hexahedral metal 1 as illustrated in an uppermost portion on a leftmost side of FIG. 3, and then to forge the hexahedral metal 1 to be hexagonal prismatic metal 2 in an overall form of a hexagonal prism as illustrated in a second portion on the leftmost side of FIG. 3. Here, edges being disposed in a diagonal direction indicates that the edges are disposed on opposite sides to each other from a center of the hexahedral metal 1. The first X-axial DF step S11 may be performed using a first mold M1 (refer to FIG. 5) that restricts a deformation of a first face F1 vertical to an X axis. Since the deformation of the first face F1 is restricted, a deformation of a second face F2 and a third face F3 that are vertical to the first face F1 may be induced when the edges E11 and E13 are pressed, and thus a protrusion may be formed by the second face F2 and the third face F3.

Subsequently, the first X-axial R-DF step S12 may be to press a protrusion formed with the remaining edges E12 and E14 among the four edges E11, E12, E13, and E14 in a 4-axial direction by rotating the hexagonal prismatic metal 2 relatively by 90 degrees (°) as illustrated in a third portion on the leftmost side of FIG. 3, and then to restore the hexagonal prismatic metal 2 to hexahedral metal 1 as illustrated in a lowermost portion on the leftmost side of FIG. 3. Here, the first X-axial R-DF step S12 may use a second mold M2 (refer to FIG. 7) that restricts the deformation of the first face F1. Since the deformation of the first face F1 is restricted, the hexagonal prismatic metal 2 may be restored to the hexahedral metal 1 of a similar form to its initial form when the protrusion is pressed.

As illustrated in the lowermost portion on the leftmost side of FIG. 3, although similar to the initial form, its microstructure may internally become finer, and thus its mechanical or physical performance may be improved. However, all parts of the structure are not yet restored to their initial positions up to this step, and thus the remaining initial edges E11 and E12 may be compressed onto the inside of the second face F2 vertical to the first face F1 of the forged hexahedral metal 1 and then be flattened, after the first X-axial R-DF step S12. That is, the two edges E11 and E12 that are pressed in the first X-axial DF step S11 may be disposed to be at a center of one of six faces forming the hexahedral metal 1 after the first X-axial R-DF step S12. That is, the structure may be partially moved, and thus yet to be restored completely. Thus, for the complete restoration, subsequent steps may need to be performed.

The second X-axial DF step S13 may be to press two edges E15 and E17 disposed in a diagonal direction among edges E15, E16, E17, and E18 in the X-axis direction of the hexahedral metal 1 as illustrated in an uppermost portion in the middle of FIG. 3, and then to forge the hexahedral metal 1 to be hexagonal prismatic metal 2 in an overall form of a hexagonal prism as illustrated in a second portion in the middle of FIG. 3. The second X-axial DF step S13 may be performed using a first mold M1 (refer to FIG. 5) that restricts a deformation of the first face F1 vertical to the X axis. Since the deformation of the first face F1 is restricted, a deformation of the second face F2 and the third face F3 that are vertical to the first face F1 may be induced when the edges E15 and E17 are pressed, and thus a protrusion may be formed by the second face F2 and the third face F3.

Subsequently, the second X-axial R-DF step S14 may be to press a protrusion formed with the remaining edges E16 and E18 among the four edges E15, E15, E17, and E18 in a 4-axial direction by rotating the hexagonal prismatic metal 2 relatively by 90° as illustrated in a third portion in the middle of FIG. 3, and then to restore the hexagonal prismatic metal 2 to hexahedral metal 1 as illustrated in a lowermost portion in the middle of FIG. 3. Here, the second X-axial R-DF step S14 may use a second mold M2 (refer to FIG. 7) that restricts the deformation of the first face F1. Since the deformation of the first face F1 is restricted, the hexagonal prismatic metal 2 may be restored to the hexahedral metal 1 of a similar form to its initial form when the protrusion is pressed.

After the second X-axial R-DF step S14, the hexahedral metal 1 may have a similar form to its initial form as illustrated in the lowermost portion in the middle of FIG. 3 and the microstructure may internally become finer, and thus its mechanical or physical performance may be improved. In addition, all parts of the structure may be completely restored to their initial positions, and it is thus possible to minimize a deformation rate and prevent damage to the structure.

The X-axis edge forging step S1 that restricts the deformation of the first face F1 vertical to the X axis may be completed with the steps described above.

The first Y-axial DF step S21 may be to press two edges E21 and E23 disposed in a diagonal direction among edges E21, E22, E23, and E24 in a Y-axis direction of the hexahedral metal 1 as illustrated in an uppermost portion on a rightmost side of FIG. 3, and then to forge the hexahedral metal 1 to be hexagonal prismatic metal 2 in an overall form of a hexagonal prism as illustrated in a second portion on the rightmost side of FIG. 3. The first Y-axial DF step S21 may be performed using a first mold M1 (refer to FIG. 5) that restricts a deformation of the second face F2 vertical to a Y axis. Since the deformation of the second face F2 is restricted, a deformation of the first face F1 and the third face F3 that are vertical to the second face F2 may be induced when the edges E21 and E23 are pressed, and thus a protrusion may be formed by the first face F1 and the third face F3.

Subsequently, the first Y-axial R-DF step S22 may be to press a protrusion formed with the remaining edges E22 and E24 among the four edges E21, E22, E23, and E24 in a 4-axial direction by rotating the hexagonal prismatic metal 2 relatively by 90° as illustrated in a third portion on the rightmost side of FIG. 3, and then to restore the hexagonal prismatic metal 2 to hexahedral metal 1 as illustrated in a lowermost portion on the rightmost side of FIG. 3. Through the first Y-axial DF step S21, each of the two edges E22 and E24 may be disposed to be at a center on one side face that is not an edge of the hexagonal prismatic metal 2. Here, the first Y-axial R-DF step S22 may use a second mold M2 (refer to FIG. 7) that restricts the deformation of the second face F2. Since the deformation of the second face F2 is restricted, the hexagonal prismatic metal 2 may be restored to the hexahedral metal 1 of a similar form to its initial form when the protrusion is pressed.

As illustrated in the lowermost portion on the rightmost side of FIG. 3, although similar to the initial form, the microstructure may internally become finer, and thus its mechanical or physical performance may be improved. However, all parts of the structure are not yet restored to their initial positions up to this step. That is, the two edges E21 and E22 that are pressed in the first Y-axial DF step S21 may be disposed to be at a center of one of six faces of the hexahedral metal 1 after the first Y-axial R-DF step S22. That is, the structure may be partially moved, and thus yet to be restored completely. Thus, for the complete restoration, subsequent steps may need to be performed.

Referring to FIG. 4, the second Y-axial DF step S23 may be to press two edges E25 and E27 disposed in a diagonal direction among edges E25, E26, E27, and E28 in the Y-axis direction of the hexahedral metal 1 as illustrated in an uppermost portion on a leftmost side of FIG. 4, and then to forge the hexahedral metal 1 to be hexagonal prismatic metal 2 in an overall form of a hexagonal prism as illustrated in a second portion on the leftmost side of FIG. 4. The second Y-axial DF step S23 may be performed using a first mold M1 (refer to FIG. 5) that restricts a deformation of the second face F2 vertical to the Y axis. Since the deformation of the second face F2 is restricted, a deformation of the first face F1 and the third face F3 that are vertical to the second face F2 may be induced when the edges E25 and E27 are pressed, and thus a protrusion may be formed by the first face F1 and the third face F3.

Subsequently, the second Y-axial R-DF step S24 may be to press a protrusion formed with the remaining edges E26 and E28 among the four edges E25, E26, E27, and E28 in a 4-axial direction by rotating the hexagonal prismatic metal 2 relatively by 90° as illustrated in a third portion on the leftmost side of FIG. 4, and then to restore the hexagonal prismatic metal 2 to hexahedral metal 1 as illustrated in a lowermost portion on the leftmost side of FIG. 4. Here, the second Y-axial R-DF step S24 may use a second mold M2 (refer to FIG. 7) that restricts the deformation of the second face F2. Since the deformation of the second face F2 is restricted, the hexagonal prismatic metal 2 may be restored to the hexahedral metal 1 of a similar form to its initial form when the protrusion is pressed.

After the second Y-axial R-DF step S24, the hexahedral metal 1 may have a similar form to its initial form as illustrated in the lowermost portion on the leftmost side of FIG. 4, and the microstructure may internally become finer, and thus its mechanical or physical performance may be improved. In addition, all parts of the structure may be completely restored to their initial positions, and it is thus possible to minimize a deformation rate and prevent damage to the structure.

The Y-axis edge forging step S2 that restricts the deformation of the second face F2 vertical to the Y axis of the initial hexahedral metal 1 may be completed with the steps described above.

The first Z-axial DF step S31 may be to press the two edges E31 and E33 disposed in a diagonal direction among the edges E31, E32, E33, and E34 in a Z-axis direction of the hexahedral metal 1 as illustrated in an uppermost portion in the middle of FIG. 4, and then to forge the hexahedral metal 1 to be hexagonal prismatic metal 2 in an overall form of a hexagonal prism as illustrated in a second portion in the middle of FIG. 4. The first Z-axial DF step S31 may be performed using a first mold M1 (refer to FIG. 5) that restricts a deformation of the third face F3 vertical to a Z axis. Since the deformation of the third face F3 is restricted, a deformation of the first face F1 and the second face F2 that are vertical to the third face F3 may be induced when the edges E31 and E33 are pressed, and thus a protrusion may be formed by the first face F1 and the second face F2.

Subsequently, the first Z-axial R-DF step S32 may be to press a protrusion formed with the remaining edges E32 and E34 among the four edges E31, E32, E33, and E34 in a 4-axial direction by rotating the hexagonal prismatic metal 2 relatively by 90° as illustrated in a third portion in the middle of FIG. 4, and then to restore the hexagonal prismatic metal 2 to hexahedral metal 1 as illustrated in a lowermost portion in the middle of FIG. 4. Through the first Z-axial DF step S31, each of the two edges E32 and E34 may be disposed to be at a center on one side face that is not an edge of the hexagonal prismatic metal 2. Here, the first Z-axial R-DF step S32 may use a second mold M2 (refer to FIG. 7)

that restricts the deformation of the third face F3. Since the deformation of the third face F3 is restricted, the hexagonal prismatic metal 2 may be restored to the hexahedral metal 1 of a similar form to its initial form when the protrusion is pressed.

As illustrated in the lowermost portion in the middle of FIG. 4, although similar to the initial form, the microstructure may internally become finer, and thus its mechanical or physical performance may be improved. However, all parts of the structure are not yet restored to their initial positions up to this step. That is, the two edges E31 and E32 that are pressed in the first Z-axial DF step S31 may be disposed to be at a center of one of six faces forming hexahedral metal after the first Z-axial R-DF step S32. That is, the structure may be partially moved, and thus yet to be restored completely. Thus, for the complete restoration, subsequent steps may need to be performed.

The second Z-axial DF step S33 may be to press two edges E35 and E37 disposed in a diagonal direction among edges E35, E36, E37, and E38 in the Z-axis direction of the hexahedral metal 1 as illustrated in an uppermost portion on a rightmost side of FIG. 4, and then to forge the hexahedral metal 1 to be hexagonal prismatic metal 2 in an overall form of a hexagonal prism as illustrated in a second portion on the rightmost side of FIG. 4. The second Z-axial DF step S33 may be performed using a first mold M1 (refer to FIG. 5) that restricts a deformation of the third face F3 vertical to the Z axis. Since the deformation of the third face F3 is restricted, a deformation of the first face F1 and the second face F2 that are vertical to the third face F3 may be induced when the edges E35 and E37 are pressed, and thus a protrusion may be formed by the first face F1 and the second face F2.

Subsequently, the second Z-axial R-DF step S34 may be to press a protrusion formed with the remaining edges E36 and E38 among the four edges E35, E36, E37, and E38 in a 4-axial direction by rotating the hexagonal prismatic metal 2 relatively by 90° as illustrated in a third portion on the rightmost side of FIG. 4, and then to restore the hexagonal prismatic metal 2 to hexahedral metal 1 as illustrated in a lowermost portion on the rightmost side of FIG. 4. Here, the second Z-axial R-DF step S34 may use a second mold M2 (refer to FIG. 7) that restricts the deformation of the third face F3. Since the deformation of the third face F3 is restricted, the hexagonal prismatic metal 2 may be restored to the hexahedral metal 1 of a similar form to its initial form when the protrusion is pressed.

After the second Z-axial R-DF step S34, the hexahedral metal 1 may have a similar form to its initial form as illustrated in the lowermost portion on the rightmost side of FIG. 4, and the microstructure may internally become finer, and thus its mechanical or physical performance may be improved. In addition, all parts of the structure may be completely restored to their initial positions, and it is thus possible to minimize a deformation rate and prevent damage to the structure.

The Z-axis edge forging step S3 that restricts the deformation of the third face F3 vertical to the Z axis of the initial hexahedral metal 1 may be completed with the steps described above.

Through the X-axis edge forging step S1, the Y-axis edge forging step S2, and the Z-axis edge forging step S3 as described above, it is possible to add a uniform deformation to the inside of hexahedral metal while minimizing a change in an outer form of the metal, and thus uniformly control a microstructure and a texture, thereby enabling the manufacture of an ultrafine metal material, for example, tantalum and copper.

Figure 6:
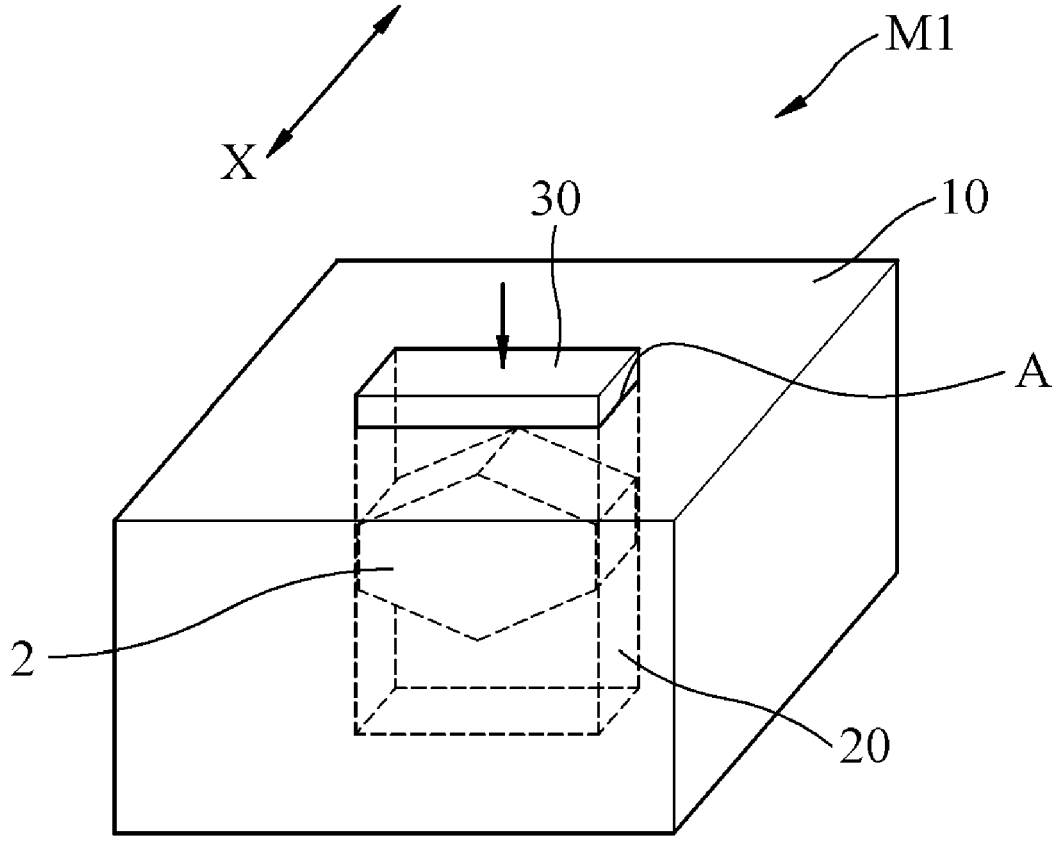
FIG. 6 is a perspective view illustrating a subsequent state after X-axial DF of a first mold that is applied to a metal processing method according to an example embodiment.

FIG. 5 is a perspective view illustrating a previous state before X-axial DF of a first mold that is applied to a metal processing method according to an example embodiment. FIG. 6 is a perspective view illustrating a subsequent state after X-axial DF of a first mold that is applied to a metal processing method according to an example embodiment.

Referring to FIGS. 5 and 6, a first mold M1 includes an accommodating jig 10 including an accommodator A having two inner faces facing each other to restrict a deformation of a face in one direction, a lower part 20 formed below the accommodator A and having a first concave slope C1 and a second concave slope C2 that are symmetrical to each other from a portion to be in contact with hexahedral metal 1, and an upper part 30 provided to be slidable in a direction approaching the lower part 20 or in a direction receding from the lower part 20 and having a third concave slope C3 and a fourth concave slope C4 that are symmetrical to each other from a portion to be in contact with the hexahedral metal 1.

When using the first mold M1, in an X-axial DF step, a Y-axial DF step, and a Z-axial DF step, the hexahedral metal 1 may be processed into hexagonal prismatic metal 2 by injecting the hexahedral metal 1 into the accommodator A and seating the hexahedral metal 1 on the lower part 20 such that edges come into contact with the lower part 20, and then by pressing the hexahedral metal 1 using the upper part 30 as illustrated in FIG. 6. As described above, using the first mold M1 may enable DF, and the DF may make a structure of metal finer while minimizing a deformation of the structure of the metal.

Figure 7:
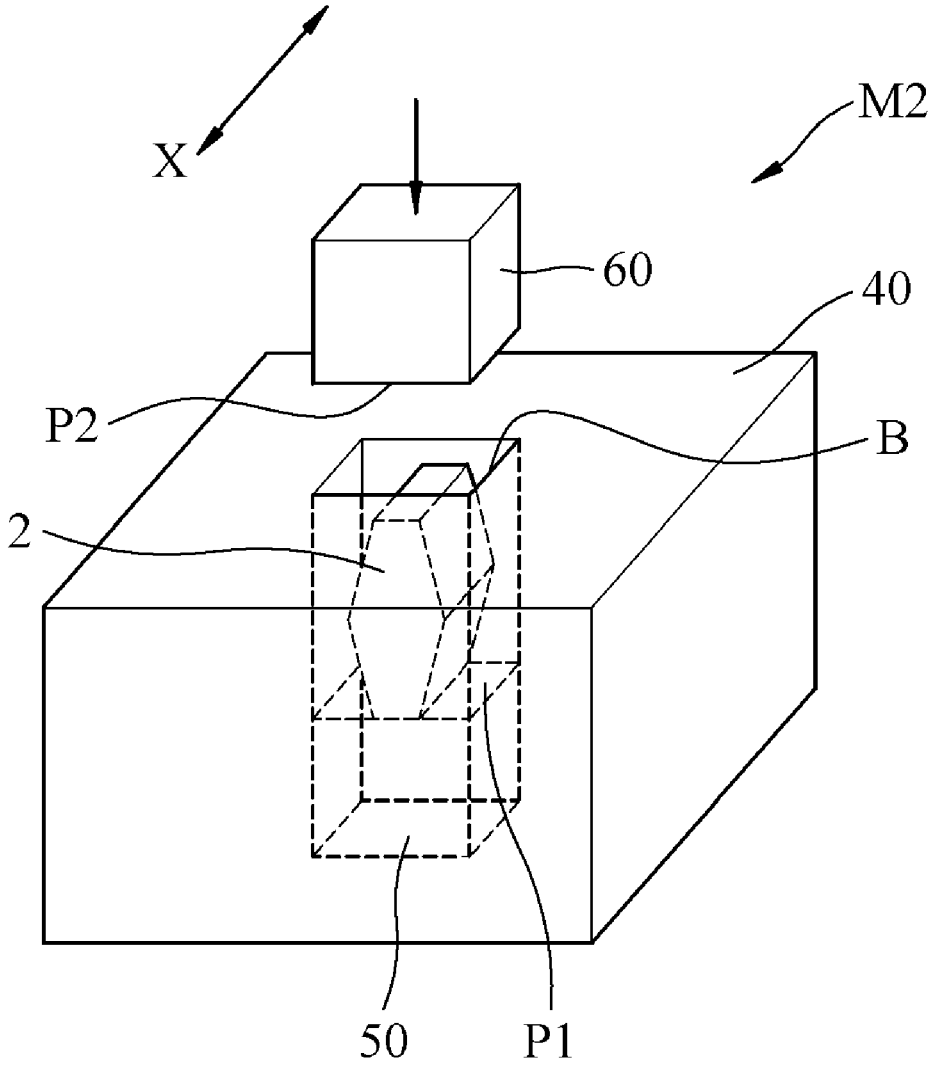
FIG. 7 is a perspective view illustrating a previous state before X-axial return-DF (R-DF) of a second mold that is applied to a metal processing method according to an example embodiment.
Figure 8:
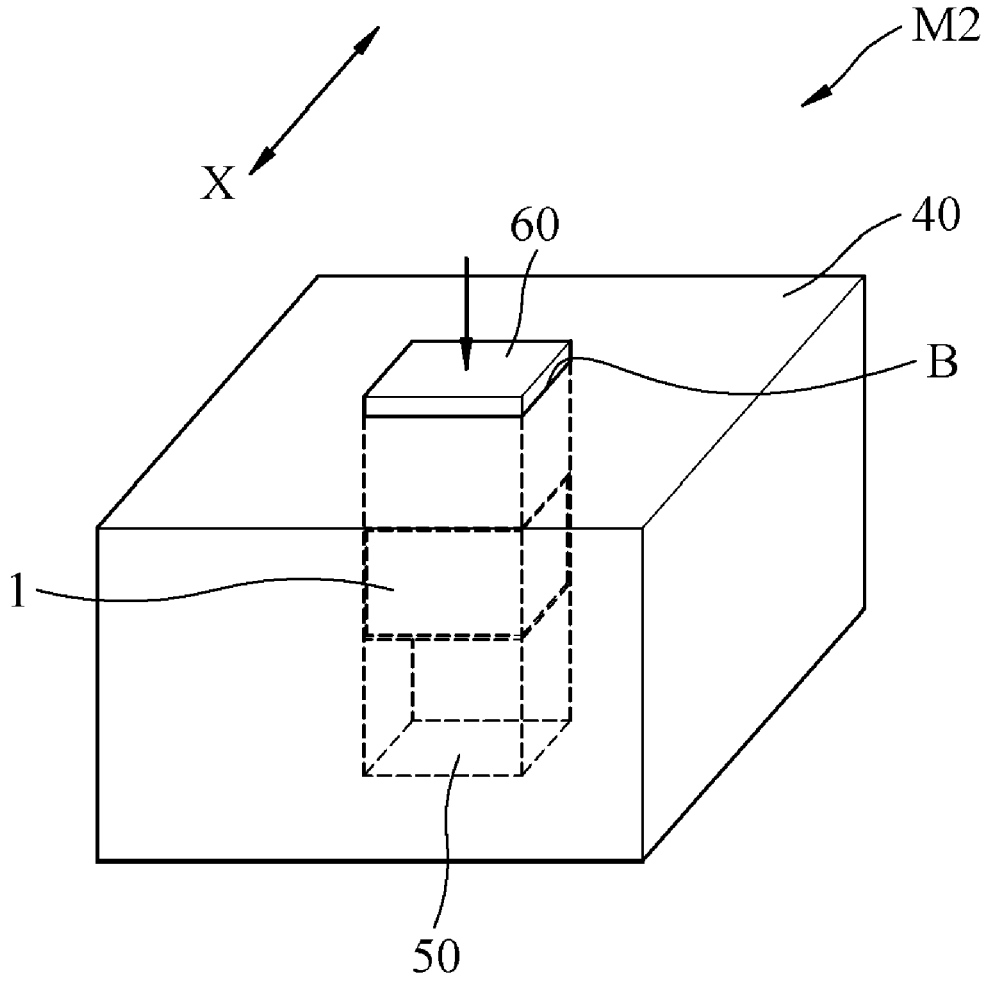
FIG. 8 is a perspective view illustrating a subsequent state after X-axial R-DF of a second mold that is applied to a metal processing method according to an example embodiment.

FIG. 7 is a perspective view illustrating a previous state before X-axial R-DF of a second mold that is applied to a metal processing method according to an example embodiment. FIG. 8 is a perspective view illustrating a subsequent state after X-axial R-DF of a second mold that is applied to a metal processing method according to an example embodiment.

Referring to FIGS. 7 and 8, a second mold M2 includes an accommodating jig 40 including an accommodator B having two inner faces facing each other to restrict a deformation of a face in one direction, a lower part 50 formed below the accommodator B and having a first plane P1 formed on a contact surface to be in contact with a lower surface of hexagonal prismatic metal 2, and an upper part 60 provided to be slidable in a direction approaching the lower part 50 or in a direction receding from the lower part 50 and having a second plane P2 formed on a contact surface to be in contact with the hexagonal prismatic metal 2.

When using the second mold M2, in an X-axial R-DF step, a Y-axial R-DF step, and a Z-axial R-DF step, the hexagonal prismatic metal 2 may be restored to the hexahedral metal 1 by injecting the hexagonal prismatic metal 2 into the accommodator B and seating the hexagonal prismatic metal 2 on the lower part 50, and then by pressing the hexagonal prismatic metal 2 using the upper part 60. As described above, using the second mold M2 may enable R-DF, and the R-DF may make a structure of metal finer while minimizing a deformation of the structure of the metal.

Figure 9:
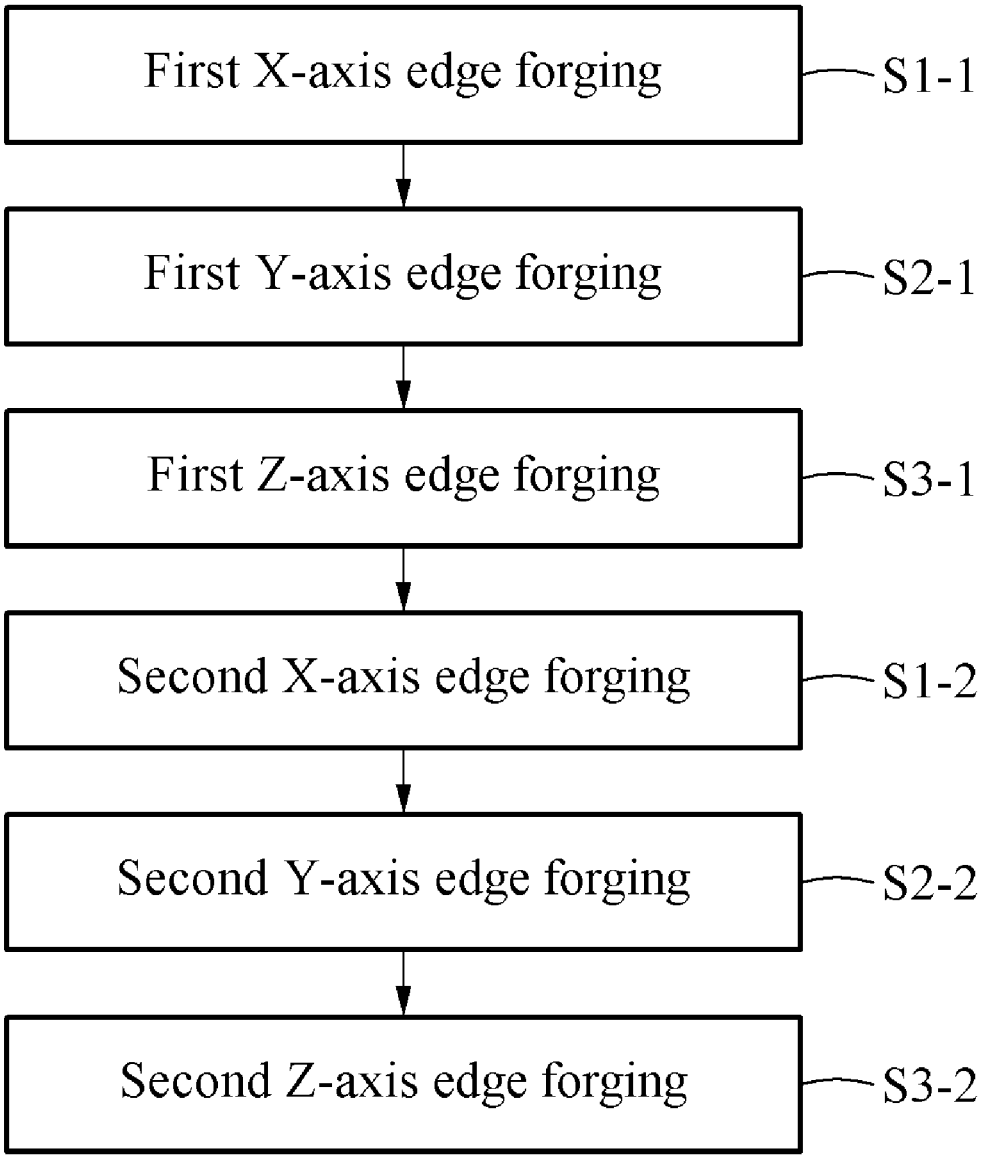
FIG. 9 is a flowchart illustrating another example of a method of processing hexahedral metal according to an example embodiment.

FIG. 9 is a flowchart illustrating another example of a method of processing hexahedral metal according to an example embodiment.

Referring to FIG. 9, a metal processing method according to an example embodiment includes an X-axis edge forging step, a Y-axis edge forging step, and a Z-axis edge forging step. Each of the X-axis edge forging step, the Y-axis edge forging step, and the Z-axis edge forging step may be performed twice. The X-axis edge forging step, the Y-axis edge forging step, and the Z-axis edge forging step may be performed in two cycles. That is, after an X-axis edge forging step S1-1, a Y-axis edge forging step S2-1, and a Z-axis edge forging step S3-1 may be performed once in sequential order, another X-axis edge forging step S1-2, another Y-axis edge forging step S2-2, and another Z-axis edge forging step S3-2 may be performed once in sequential order.

Figure 11:
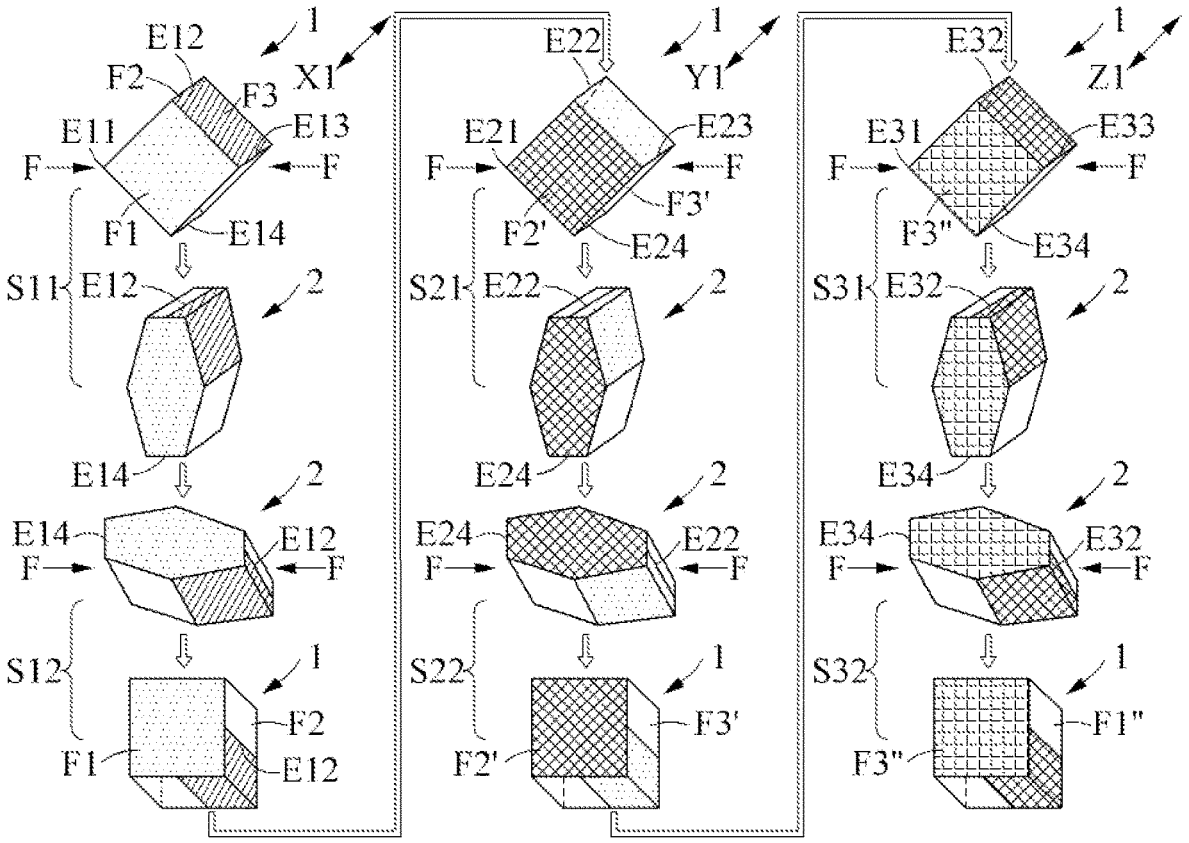
FIG. 11 is a conceptual diagram illustrating in stages a portion of a metal processing step in the metal processing method of FIG. 9.
Figure 12:
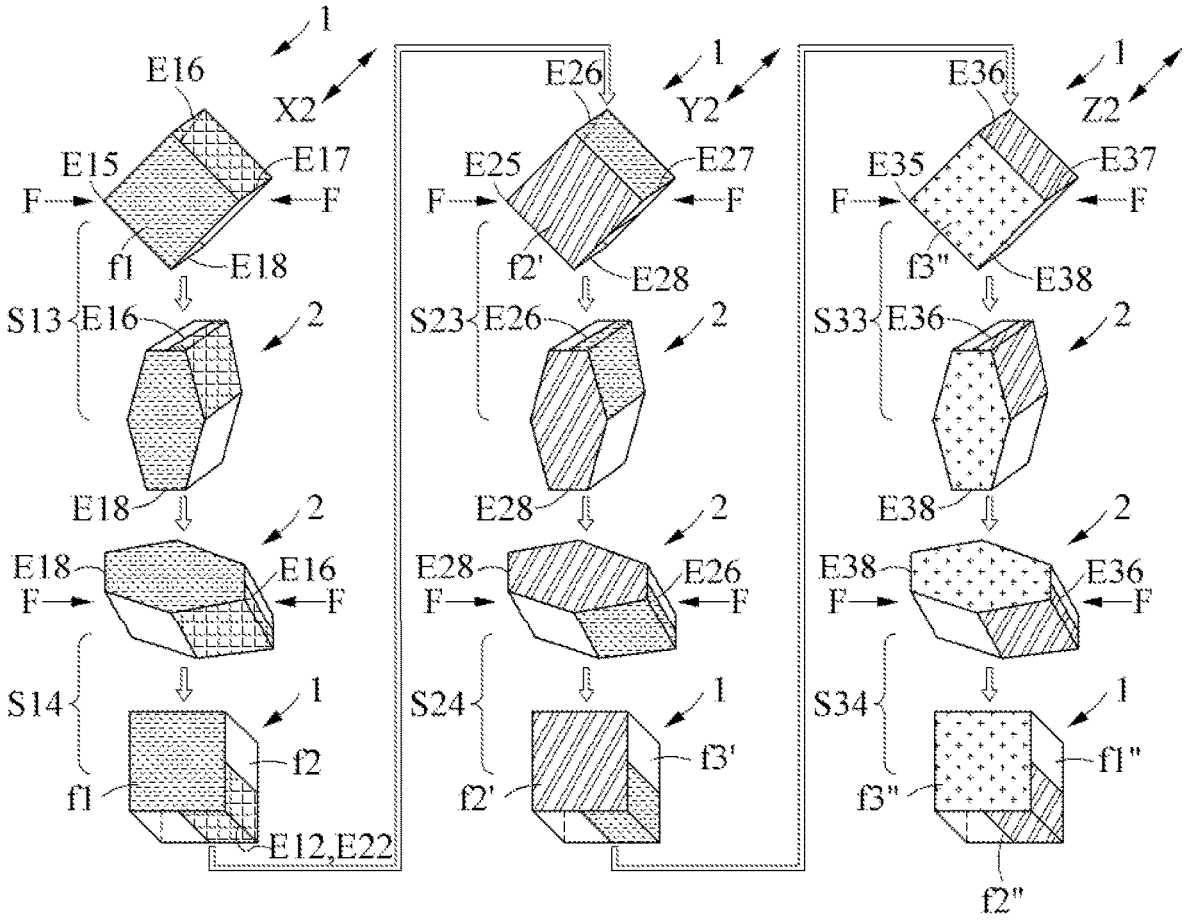
FIG. 12 is a conceptual diagram illustrating in stages a remaining portion of the metal processing step after the portion illustrated in FIG. 11 in the metal processing method of FIG. 9.

A target to be processed may be hexahedral metal 1 in an overall form of a hexahedron that has four edges E11, E12, E13, and E14 in an X-axis direction, and four edges E21, E22, E23, and E24 in a Y-axis direction, and four edges E31, E32, E33, and E34 in a Z-axis direction, as illustrated in FIGS. 11 and 12. However, the hexahedral metal 1 is not limited to the illustrated form or shape and may be formed in various forms or shapes, or sizes having various ratios. The hexahedral metal 1 may be of a material, for example, tantalum or copper.

For example, the X-axis edge forging step may be to press the four edges E11, E12, E13, and E14 formed in the X-axis direction of the hexahedral metal 1. The Y-axis edge forging step may be to press the four edges E21, E22, E23, and E24 formed in the Y-axis direction of the hexahedral metal 1. The Z-axis edge forging step may be to press the four edges E31, E32, E33, and E34 formed in the Z-axis direction of the hexahedral metal 1.

Figure 10:
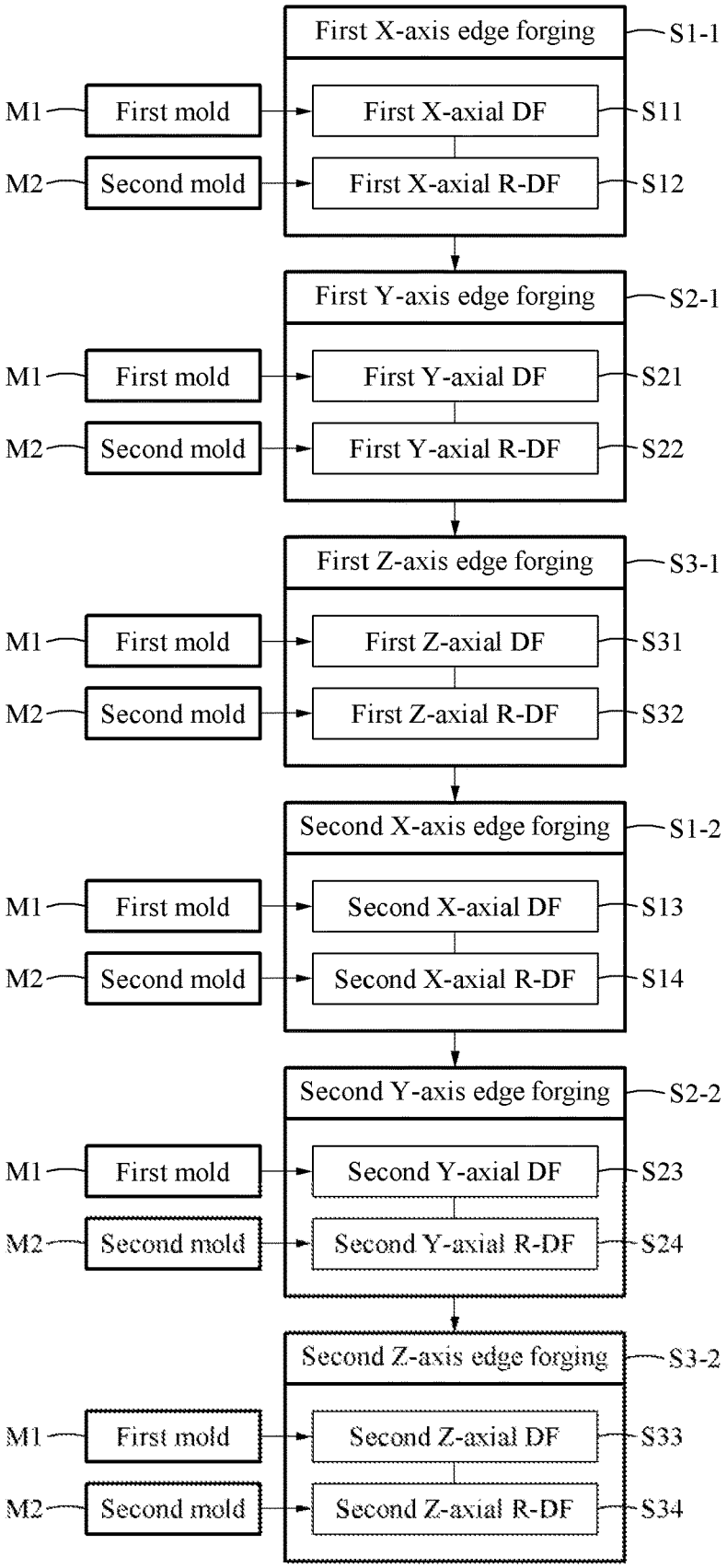
FIG. 10 is a detailed flowchart illustrating the method of processing hexahedral metal of FIG. 9.

FIG. 10 is a detailed flowchart illustrating the method of processing hexahedral metal of FIG. 9.

Referring to FIG. 10, the X-axis edge forging step includes a first X-axis edge forging step S1-1 and a second X-axis edge forging step S1-2. The first X-axis edge forging step S1-1 includes a first X-axial DF step S11 and a first X-axial R-DF step S12. The second X-axis edge forging step S1-2 includes a second X-axial DF step S13 and a second X-axial R-DF step S14.

The first X-axial DF step S11 and the second X-axial DF step S13 may be performed through a first mold M1 (refer to FIG. 5). The first X-axial R-DF step S12 and the second X-axial R-DF step S14 may be performed using a second mold M2 (refer to FIG. 7).

The Y-axis edge forging step includes a first Y-axis edge forging step S2-1 and a second Y-axis edge forging step S2-2. The first Y-axis edge forging step S2-1 includes a first Y-axial DF step S21 and a first Y-axial R-DF step S22. The second Y-axis edge forging step S2-2 includes a second Y-axial DF step S23 and a second Y-axial R-DF step S24.

The first Y-axial DF step S21 and the second Y-axial DF step S23 may be performed through a first mold M1 (refer to FIG. 5). The first Y-axial R-DF step S22 and the second Y-axial R-DF step S24 may be performed using a second mold M2 (refer to FIG. 7).

The Z-axis edge forging step includes a first Z-axis edge forging step S3-1 and a second Z-axis edge forging step S3-2. The first Z-axis edge forging step S3-1 includes a first Z-axial DF step S31 and a first Z-axial R-DF step S32. The second Z-axis edge forging step S3-2 includes a second Z-axial DF step S33 and a second Z-axial R-DF step S34.

The first Z-axial DF step S31 and the second Z-axial DF step S33 may be performed through a first mold M1 (refer to FIG. 5). The first Z-axial R-DF step S32 and the second Z-axial R-DF step S34 may be performed using a second mold M2 (refer to FIG. 7).

FIG. 11 is a conceptual diagram illustrating in stages a portion of a metal processing step in the metal processing method of FIG. 9. FIG. 12 is a conceptual diagram illustrating in stages a remaining portion of the metal processing step after the portion illustrated in FIG. 11 in the metal processing method of FIG. 9.

In FIGS. 11 and 12, faces illustrated without patterns are not necessarily the same faces but are merely not patterned for the convenience of description. For example, faces that are not patterned in steps S11 and S12 are the same faces, but faces that are not patterned in steps S12 and S13 are different faces.

Referring to FIGS. 11 and 12, the first X-axial DF step S11 may be to press two edges E11 and E13 disposed in a diagonal direction among edges E11, E12, E13, and E14 in an X1-axis direction of hexahedral metal 1 as illustrated in an uppermost portion on a leftmost side of FIG. 11, and then to forge the hexahedral metal 1 to be hexagonal prismatic metal 2 in an overall form of a hexagonal prism as illustrated in a second portion on the leftmost side of FIG. 11. Here, edges being disposed in a diagonal direction indicates that the edges are disposed on opposite sides to each other from a center of the hexahedral metal 1. The first X-axial DF step S11 may be performed using a first mold M1 (refer to FIG. 5) that restricts a deformation of a first face F1 vertical to an X1 axis. Since the deformation of the first face F1 is restricted, a deformation of a second face F2 and a third face F3 that are vertical to the first face F1 may be induced when the edges E11 and E13 are pressed, and thus a protrusion may be formed by the second face F2 and the third face F3.

Subsequently, the first X-axial R-DF step S12 may be to press a protrusion formed with the remaining edges E12 and E14 among the four edges E11, E12, E13, and E14 in a 4-axial direction by rotating the hexagonal prismatic metal 2 relatively by 90° as illustrated in a third portion on the leftmost side of FIG. 11, and then to restore the hexagonal prismatic metal 2 to hexahedral metal 1 as illustrated in a lowermost portion on the leftmost side of FIG. 11. Here, the first X-axial R-DF step S12 may use a second mold M2 (refer to FIG. 7) that restricts the deformation of the first face F1. Since the deformation of the first face F1 is restricted, the hexagonal prismatic metal 2 may be restored to the hexahedral metal 1 of a similar form to its initial form when the protrusion is pressed.

As illustrated in the lowermost portion on the leftmost side of FIG. 11, although similar to the initial form, its microstructure may internally become finer, and thus its mechanical or physical performance may be improved. However, all parts of the structure are not yet restored to their initial positions up to this step, and thus the remaining initial edges E11 and E12 may be compressed onto the inside of the second face F2 vertical to the first face F1 of the forged hexahedral metal 1 and then be flattened, after the first X-axial R-DF step S12. That is, the two edges E11 and E12 that are pressed in the first X-axial DF step S11 may be disposed to be at a center of one of six faces forming the hexahedral metal 1 after the first X-axial R-DF step S12.

The first Y-axial DF step S21 may be to press two edges E21 and E23 disposed in a diagonal direction among edges E21, E22, E23, and E24 in a Y1-axis direction of the hexahedral metal 1 as illustrated in an uppermost portion in the middle of FIG. 11, and then to forge the hexahedral metal 1 to be hexagonal prismatic metal 2 in an overall form of a hexagonal prism as illustrated in a second portion in the middle of FIG. 11. The first Y-axial DF step S21 may be performed using a first mold M1 (refer to FIG. 5) that restricts a deformation of a second face F2' vertical to a Y1 axis. Since the deformation of the second face F2' is restricted, a deformation of the first face F1 and a third face F3' that are vertical to the second face F2' may be induced when the edges E21 and E23 are pressed, and thus a protrusion may be formed by the first face F1 and the third face F3'.

Subsequently, the first Y-axial R-DF step S22 may be to press a protrusion formed with the remaining edges E22 and E24 among the edges E21, E22, E23, and E24 in a 4-axial direction by rotating the hexagonal prismatic metal 2 relatively by 90° as illustrated in a third portion in the middle of FIG. 11, and then to restore the hexagonal prismatic metal 2 to hexahedral metal 1 as illustrated in a lowermost portion in the middle of FIG. 11. Here, the first Y-axial R-DF step S22 may use a second mold M2 (refer to FIG. 7) that restricts the deformation of the second face F2'. Since the deformation of the second face F2' is restricted, the hexagonal prismatic metal 2 may be restored to the hexahedral metal 1 of a similar form to its initial form when the protrusion is pressed.

After the first Y-axial R-DF step S22, the hexahedral metal 1 may have a similar form to its initial form as illustrated in the lowermost portion in the middle of FIG. 11, and the microstructure may internally become finer and thus its mechanical or physical performance may be improved. It is thus possible to minimize a deformation rate and prevent damage to the structure.

The first Z-axial DF step S31 may be to press two edges E31 and E33 disposed in a diagonal direction among edges E31, E32, E33, and E34 in a Z1-axis direction of the hexahedral metal 1 as illustrated in an uppermost portion on a rightmost side of FIG. 11, and then to forge the hexahedral metal 1 to be hexagonal prismatic metal 2 in an overall form of a hexagonal prism as illustrated in a second portion on the rightmost side of FIG. 11. The first Z-axial DF step S31 may be performed using a first mold M1 (refer to FIG. 5) that restricts a deformation of a third face F3" vertical to a Z1 axis. Since the deformation of the third face F3" is restricted, a deformation of a first face F1" and the second face F2 that are vertical to the third face F3" may be induced when the edges E31 and E33 are pressed, and thus a protrusion may be formed by the first face F1" and the second face F2.

Subsequently, the first Z-axial R-DF step S32 may be to press a protrusion formed with the remaining edges E32 and E34 among the four axial-direction edges E31, E32, E33, and E34 in a 4-axial direction by rotating the hexagonal prismatic metal 2 relatively by 90° as illustrated in a third portion on the rightmost side of FIG. 11, and then to restore the hexagonal prismatic metal 2 to hexahedral metal 1 as illustrated in a lowermost portion on the rightmost side of FIG. 11. Here, the first Z-axial R-DF step S32 may use a second mold M2 (refer to FIG. 7) that restricts the deformation of the third face F3". Since the deformation of the third face F3" is restricted, the hexagonal prismatic metal 2 may be restored to the hexahedral metal 1 of a similar form to its initial form when the protrusion is pressed.

As illustrated in the lowermost portion on the rightmost side of FIG. 11, although similar to the initial form, the microstructure may internally become finer, and thus its mechanical or physical performance may be improved.

Referring to FIG. 12, the second X-axial DF step S13 may be to press two edges E15 and E17 disposed in a diagonal direction among edges E15, E16, E17, and E18 in an X2-axis direction of the hexahedral metal 1 as illustrated in an uppermost portion on a leftmost side of FIG. 12, and then to forge the hexahedral metal 1 to be hexagonal prismatic metal 2 in an overall form of a hexagonal prism as illustrated in a second portion on the leftmost side of FIG. 12. Here, an X2 axis may be different from the X1 axis. The second X-axial DF step S13 may be performed using a first mold M1 (refer to FIG. 5) that restricts a deformation of a first face f1 vertical to the X2 axis. Since the deformation of the first face f1 is restricted, a deformation of a second face f2 and a third face f3 that are vertical to the first face f1 may be induced when the edges E15 and E17 are pressed, and thus a protrusion may be formed by the second face f2 and the third face f3.

Subsequently, the second X-axial R-DF step S14 may be to press a protrusion formed with the remaining edges E16 and E18 among the four edges E15, E15, E17, and E18 in a 4-axial direction by rotating the hexagonal prismatic metal 2 relatively by 90° as illustrated in a third portion on the leftmost side of FIG. 12, and then to restore the hexagonal prismatic metal 2 to hexahedral metal 1 as illustrated in a lowermost portion on the leftmost side of FIG. 12. Here, the second X-axial R-DF step S14 may use a second mold M2 (refer to FIG. 7) that restricts the deformation of the first face f1. Since the deformation of the first face f1 is restricted, the hexagonal prismatic metal 2 may be restored to the hexahedral metal 1 of a similar form to its initial form when the protrusion is pressed.

After the second X-axial R-DF step S14, the hexahedral metal 1 may have a similar form to its initial form as illustrated in the lowermost portion on the leftmost side of FIG. 12, and the microstructure may internally become finer, and thus its mechanical or physical performance may be improved.

The second Y-axial DF step S23 may be to press two edges E25 and E27 disposed in a diagonal direction among edges E25, E26, E27, and E28 in a Y2-axis direction of hexahedral metal 1 as illustrated in an uppermost portion in the middle of FIG. 12, and then to forge the hexahedral metal 1 to be hexagonal prismatic metal 2 in an overall form of a hexagonal prism as illustrated in a second portion in the middle of FIG. 12. Here, a Y2 axis may be different from the Y1 axis. The second Y-axial DF step S23 may be performed using a first mold M1 (refer to FIG. 5) that restricts a deformation of a second face f2' vertical to the Y2 axis. Since the deformation of the second face f2' is restricted, a deformation of a first face and a third face f3' that are vertical to the second face f2' may be induced when the edges E25 and E27 are pressed, and thus a protrusion may be formed by the first face and the third face f3'.

Subsequently, the second Y-axial R-DF step S24 may be to press a protrusion formed with the remaining edges E26 and E28 among the four edges E25, E26, E27, and E28 in the Y2-axis direction by rotating the hexagonal prismatic metal 2 relatively by 90° as illustrated in a third portion in the middle of FIG. 12, and then to restore the hexagonal prismatic metal 2 to the hexahedral metal 1 as illustrated in a lowermost portion in the middle of FIG. 12. Through the second Y-axial R-DF step S24, each of the two edges E26 and E28 may be disposed to be at a center on one side face that is not an edge of the hexagonal prismatic metal 2. Here, the second Y-axial R-DF step S24 may use a second mold M2 (refer to FIG. 7) that restricts the deformation of the second face f2'. Since the deformation of the second face f2' is restricted, the hexagonal prismatic metal 2 may be restored to the hexahedral metal 1 of a similar form to its initial form when the protrusion is pressed.

As illustrated in the lowermost portion in the middle of FIG. 12, although similar to the initial form, the microstructure may internally become finer, and thus its mechanical or physical performance may be improved.

The second Z-axial DF step S33 may be to press two edges E35 and E37 disposed in a diagonal direction among edges E35, E36, E37, and E38 in a Z2-axis direction of the hexahedral metal 1 as illustrated in an uppermost portion on a rightmost side of FIG. 12, and then to forge the hexahedral metal 1 to be hexagonal prismatic metal 2 in an overall form of a hexagonal prism as illustrated in a second portion on the rightmost side of FIG. 12. Here, a Z2 axis may be different from the Z1 axis. The second Z-axial DF step S33 may be performed using a first mold M1 (refer to FIG. 5) that restricts a deformation of a third face f3" vertical to the Z2 axis. Since the deformation of the third face f3" is restricted, a deformation of a first face f1" and a second face f2" that are vertical to the third face f3" may be induced when the edges E35 and E37 are pressed, and thus a protrusion may be formed by the first face f1" and the second face.

Subsequently, the second Z-axial R-DF step S34 may be to press a protrusion formed with the remaining edges E36 and E38 among the four edges E35, E36, E37, and E38 in a 4-axial direction by rotating the hexagonal prismatic metal 2 relatively by 90° as illustrated in a third portion on the rightmost side of FIG. 12, and then to restore the hexagonal prismatic metal 2 to hexahedral metal 1 as illustrated in a lowermost portion on the rightmost side of FIG. 12. Here, the second Z-axial R-DF step S34 may use a second mold M2 (refer to FIG. 7) that restricts the deformation of the third face f3". Since the deformation of the third face f3" is restricted, the hexagonal prismatic metal 2 may be restored to the hexahedral metal 1 of a similar form to its initial form when the protrusion is pressed.

After the second Z-axial R-DF step S34, the hexahedral metal 1 may have a similar form to its initial form as illustrated in the lowermost portion on the rightmost side of FIG. 12, and the microstructure may internally become finer and thus its mechanical or physical performance may be improved.

Thus, it is possible to add a uniform deformation to the inside of hexahedral metal while minimizing a change in an outer form of the metal, and thus uniformly control a microstructure and a texture, thereby enabling the manufacture of an ultrafine metal material, for example, tantalum and copper.

According to example embodiments described herein, a method of processing hexahedral metal may repeat DF and R-DF to add a uniform deformation to the inside of the metal while minimizing a change in an outer form of the metal, thereby uniformly controlling a microstructure and a texture and enabling the manufacture of an ultrafine metal material such as tantalum and copper. However, the scope of the example embodiments of the present disclosure is not limited by such advantageous effects as described above, and the advantageous effects of the present disclosure are not limited to the foregoing advantageous effects.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents.

Therefore, the scope of the disclosure is defined not by the detailed description, but by the claims and their equivalents, and all variations within the scope of the claims and their equivalents are to be construed as being included in the disclosure.

What is claimed is:

1. A method of processing a hexahedral metal, comprising:

a first X-axis edge forging step including X-axial diagonal forging to press two of a first set of four X-axis edges on opposite sides to each other of a first hexahedral metal to form a first hexagonal prismatic metal, followed by X-axial return diagonal forging of the first hexagonal prismatic metal to form a second hexahedral metal having a second set of four X-axis edges that are different than the first set of four X-axis edges of the first hexahedral metal;

a second X-axis edge forging step including X-axial diagonal forging to press two of the second set of four X-axis edges on opposite sides to each other to form a second hexagonal prismatic metal, followed by X-axial return diagonal forging of the second hexagonal prismatic metal to form a third hexahedral metal;

a first Y-axis edge forging step including Y-axial diagonal forging to press two of a first set of four Y-axis edges on opposite sides to each other of the third hexahedral metal to form a third hexagonal prismatic metal, followed by Y-axial return diagonal forging of the third hexagonal prismatic metal to form a fourth hexahedral metal having a second set of four Y-axis edges that are different than the first set of four Y-axis edges of the third hexahedral metal;

a second Y-axis edge forging step including Y-axial diagonal forging to press two of the second set of four Y-axis edges on opposite sides to each other of the fourth hexahedral metal to form a fourth hexagonal prismatic metal, followed by Y-axial return diagonal forging of the fourth hexagonal prismatic metal to form a fifth hexahedral metal having a third set of four Y-axis edges that are different than the second set of four Y-axis edges of the fourth hexahedral metal;

a first Z-axis edge forging step including Z-axial diagonal forging to press two of a first set of four Z-axis edges on opposite sides to each other of the fifth hexahedral metal to form a fifth hexagonal prismatic metal, followed by Z-axial return diagonal forging of the fifth hexagonal prismatic metal to form a sixth hexahedral metal having a second set of four Z-axis edges that are different than the first set of four Z-axis edges of the fifth hexahedral metal; and a second Z-axis edge forging step including Z-axial diagonal forging to press two of the second set of four Z-axis edges on opposite sides to each other of the sixth hexahedral metal to form a sixth hexagonal prismatic metal, followed by Z-axial return diagonal forging of the sixth hexagonal prismatic metal to form a seventh hexahedral metal having a third set of four Z-axis edges that are different than the second set of four Z-axis edges of the sixth hexahedral metal.

2. The method of claim 1, wherein each of the X-axial diagonal forging, the Y-axial diagonal forging, and the Z-axial diagonal forging is performed using a first mold.

3. The method of claim 2, wherein each of the X-axial return diagonal forging, the Y-axial return diagonal forging, and the Z-axial return diagonal forging is performed using a second mold that is different than the first mold.

4. The method of claim 3, wherein the first mold accommodates one edge of the first hexahedral metal, the second hexahedral metal, the third hexahedral metal, the fourth hexahedral metal, the fifth hexahedral metal, and the sixth hexahedral metal during the corresponding diagonal forging.

5. The method of claim 4, wherein the second mold supports a side face of the first hexagonal prismatic metal, the second hexagonal prismatic metal, the third hexagonal prismatic metal, the fourth hexagonal prismatic metal, the fifth hexagonal prismatic metal, and the sixth hexagonal prismatic metal during the corresponding return diagonal forging.

6. The method of claim 5, wherein the first mold includes a first accommodating jig with a first accommodator having a first pair of inner faces that face each other.

7. The method of claim 6, wherein the first mold includes a second accommodating jig with a second accommodator having a second pair of inner faces that face each other.

* * * * *